US006236829B1

(12) United States Patent
Uehara et al.

(10) Patent No.: US 6,236,829 B1
(45) Date of Patent: May 22, 2001

(54) FIXING DEVICE

(75) Inventors: Yasuhiro Uehara; Yoshio Kanesawa, both of Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/478,517

(22) Filed: Jan. 6, 2000

Related U.S. Application Data

(62) Division of application No. 09/165,282, filed on Oct. 2, 1998, now Pat. No. 6,029,038.

(30) Foreign Application Priority Data

Oct. 16, 1997 (JP) ..... 9-283361
Aug. 21, 1998 (JP) ..... 10-235499

(51) Int. Cl.[7] ..... G03G 15/20
(52) U.S. Cl. ..... 399/323
(58) Field of Search ..... 399/322, 323

(56) References Cited

U.S. PATENT DOCUMENTS 4,687,696 8/1987 Satoji ..... 428/192
4,929,983 * 5/1990 Barton et al. ..... 399/323
5,532,810 7/1996 Cahill ..... 399/323
5,802,434 * 9/1998 Takehara et al. ..... 399/323

FOREIGN PATENT DOCUMENTS 59-188681 10/1984 (JP) .
2-216171 8/1990 (JP) .

* cited by examiner

*Primary Examiner*—William J. Royer
(74) *Attorney, Agent, or Firm*—Oliff & Berridge, PLC

(57) ABSTRACT

A fixing device having a peeling sheet capable of performing stable peeling without causing any damage to the image, the sheet, and the fixing roller. A fixing device, including: a fixing roller having an elastic layer formed on the surface thereof which rotates in a direction indicated by an arrow A; a compression roller which rotates in a direction indicated by an arrow B while being in contact with the fixing roller; and a plastic peeling sheet, whose end edge comes into contact with the surface of the fixing roller to peel the sheet P, which has passed through the nip portion N, away from the surface of the fixing roller, provided downstream of the nip portion N of the fixing roller in the direction of rotation A thereof.

12 Claims, 9 Drawing Sheets

Figure 12

| | Toner | Weight of Toner ($mg/cm^2$) | Image Glossiness (gloss) | Maximum Peeling Force (g) |
|---|---|---|---|---|
| Monochrome fixing (Fluorine resin roller) | Vivace 550 toner | 0.65 | 8 | 10 |
| Color fixing (Fluorine resin roller) | A Color Toner + Wax | 2.0 | 80 | 130 |
| | | 1.3 | 68 | 90 |
| | | 0.65 | 60 | 50 |
| | | 0.65 | 15 | 17 |

Figure 13

| | Toner | Thickness of elastic layer (mm) | Thickness of surface layer (μm) | Maximum Peeling Force (g) |
|---|---|---|---|---|
| Color fixing (Elastic member roller of Silicone rubber elastic layer + Fluorine resin surface layer) | A Color Toner + Wax ($2.0\ mg/cm^2$) | 0 | 20 (PFA tube) | 130 |
| | | 0.15 | | 90 |
| | | 0.03 | | 65 |
| | | 0.50 | | 60 |
| | | 1.0 | | 55 |

Figure 14

| | Toner | Maximum Peeling Force (g) | | | |
|---|---|---|---|---|---|
| | | Amount of oil supplied (mg/A4 size sheet) | | | |
| | | 0 | 1 | 5 | 10 |
| Color fixing (Elastic member roller of Silicone rubber elastic layer alone) | A Color Toner + Wax (2.0 mg/cm$^2$) | 65 g (Wear) | 20 g | 5 g | 1 g |

Figure 15

| | Distance between nip outlet and peeling point | | | | |
|---|---|---|---|---|---|
| | 3 mm | 4mm | 5mm | 6mm | 7mm |
| Uneven gloss | O | O | O | X | X |

Figure 16

Paper thickness: 100 μm

| | Clearance between end edge of peeling sheet and fixing roller | | | | | | |
|---|---|---|---|---|---|---|---|
| | 3 μ m | 5 μ m | 25 μ m | 50 μ m | 75 μ m | 100 μ m | 125 μ m |
| Stains on peeling film | Δ | O | O | O | O | O | O |
| Peeling performance | O | O | O | O | O | O | X |

FIXING DEVICE

This is a Division of application Ser. No. 09/165,282 filed Oct. 2, 1998, now U.S. Pat. No. 6,028,038. The entire disclosure of the prior application is hereby incorporated by reference herein its entirety.

BACKGROUND OF THE INVENTION

[Detailed Description of the Invention]

1. Technical Field of the Invention

The present invention relates to a fixing device for use in an image recording apparatus of the electrophotographic type such as an electronic copying machine or a facsimile.

2. Prior Art

Conventionally, in an image recording apparatus of the electrophotographic type such as an electronic copying machine or a facsimile, there is widely used a fixing device in which a sheet having a toner image transferred thereto is passed through a nip portion between a pair of rollers consisting of a fixing roller and a compression roller to thereby fuse the toner image to the sheet by means of heating by the fixing roller and compression by the two rollers.

Generally, in this fixing method, since the toner image fused to the sheet comes into contact with the fixing roller, a roller having a fluorine resin coating layer with high mold release characteristics is used. However, even if such a fixing roller is used, the fused toner easily adheres to the surface of the fixing roller because it is soft and highly viscous, and the sheet may wind around the fixing roller. Thus, there is normally adopted a method to prevent the sheet from winding around the fixing roller with the provision of a forced peeling device using such a peeling claw as described below.

FIG. 10 is a schematic structural view showing a conventional fixing device having a forced peeling device using a peeling claw.

As shown in FIG. 10, this fixing device comprises: a fixing roller 1 incorporating a heater 2 therein, which rotates in a direction indicated by an arrow A; a compression roller 6, which rotates in a direction indicated by an arrow B in contact with the fixing roller 1; and a peeling claw 10, whose end edge comes into contact with the surface of the fixing roller 1 to peel a sheet P, which has passed through a nip portion N, away from the fixing roller 1, provided downstream of the nip portion N where the fixing roller 1 and the compression roller 6 contact one another with respect to the direction of rotation of the fixing roller 1. As the compression roller 6, a rubber roller is normally used, and is arranged so as to press against the fixing roller 1 at predetermined pressure.

As the peeling claw 10, there has conventionally been used a peeling claw obtained by molding heat-resistant resin such as polyimide and polyphenylene sulfite and finishing its tip end into a sharp shape. Such a peeling claw 10 is arranged such that it is pressed against the surface of the fixing roller 1 using a spring. The width of the end edge of the peeling claw 10, which comes into contact with the surface of the fixing roller 1, is nearly 2 mm, and a plurality of the peeling claws 10 with narrow widths are normally arranged in the axial direction of the fixing roller 1. Since the peeling claws 10 only partially come into contact with the surface of the fixing roller 1 in this way, uneven pressure due to the peeling claws 10 is applied onto the surface of the fixing roller 1 in the axial direction thereof, and as a result, the surface may be partially worn or scratched. Also, in a case where the sheet hooks on any one of the plurality of peeling claws to cause winding of the sheet, the adjacent peeling claws may receive an unusual force caused by the sheet to be strongly pressed against the fixing roller 1, or to be deformed, thus seriously scratching the surface of the fixing roller 1 or causing partial wear.

In order to solve such problems, there is disclosed in Japanese Published Unexamined Patent Application No. Sho 59-188681 a fixing device for peeling a sheet by means of the following plastic peeling sheet.

FIG. 11 is a schematic structural view showing a conventional fixing device having a forced peeling device using a plastic peeling sheet.

As shown in FIG. 11, this fixing device comprises: a fixing roller 1 incorporating a heater 2, which rotates in a direction indicated by an arrow A; a compression roller 6, which rotates in a direction indicated by an arrow B in contact with the fixing roller 1; and a peeling sheet 11, whose end edge comes into contact with the surface of the fixing roller 1 to peel a sheet P, which has passed through a nip portion N, away from the fixing roller 1, provided downstream of the nip portion N where the fixing roller 1 and the compression roller 6 contact one another with respect to the direction of rotation of the fixing roller 1. For the peeling sheet 11, there is used a plastic sheet having a thickness of 0.05 mm or more, flexural modulus of elasticity of $10^3$ kg/cm$^2$ or more and a melting point of 150° C. or higher, and it is arranged so that its sharp end edge comes into uniform contact with the entire surface of the fixing roller 1 in the axial direction therefor.

[Problems to be Solved by the Invention]

For example, during formation of a monochrome image, peeling can be performed without any problems in the case where a toner image immediately after fixing is comparatively thin and is highly viscous like. However, in the case where a toner image immediately after fixed is comparatively thick and has high adhesion when heated at high temperatures by the fixing roller like during formation of a color image, there may occur a phenomenon that a large quantity of toner has adhered to a fluorine resin layer on the surface of the fixing roller, and an excessive peeling force acts on the end edge of a thin-film peeling sheet, so that the tip end thereof is plastically deformed and curls up, and as a result, the sheet cannot be peeled. Also, at the same time, the tip end of the sheet may also be damaged seriously to curl up, to become wavy, or to cause paper jamming. Particularly in the case of fixing of a full-color image, since toner of four colors, namely magenta, yellow, cyan and black, is used, a non-fixed toner image formed by superposedly transferring a larger quantity of toner than at the time of fixing a monochrome image must be fixed, and a great peeling force is required on peeling. Further, in the case of fixing a color image, it is necessary to cause the toner to develop colors sufficiently, and for this end, the toner must be sufficiently heated and fused. Therefore, since the toner immediately after it passes through the nip portion has low viscosity, an increasingly greater peeling force will be required.

If the peeling sheet has a thickness of, for example, 200 $\mu$m or more in order to cause the peeling sheet not to be deformed even if a great peeling force is applied to the peeling sheet, it will be possible to prevent the peeling sheet from being deformed. However, if the edge portion at the end edge of the peeling sheet has a thickness more than several times larger than the thickness of the sheet to be peeled, it is impossible to stably peel the sheet. Also, if the thickness of the peeling sheet is made excessively thick, the greater flexural rigidity thereof may damage the fixing roller.

In the case where a plurality of peeling claws, which have most frequently been used on fixing a conventional monochrome image, are used in place of the peeling sheet, the above-described problems in the peeling sheet will not occur, but a toner image after fixing is forcibly peeled away by the peeling claws, and therefore, the toner image is damaged by the peeling claws to easily cause image defects. Therefore, the color image is hardly peeled forcibly by the peeling claws.

Under such circumstances, a self-stripping method is often adopted for fixing a color image. The self-stripping method is a peeling method whereby the sheet is arranged to be naturally peeled away from the fixing roller by means of the rigidity of the sheet and the elasticity of the fixing roller instead of using any forced peeling device using peeling claws, a peeling sheet or the like. As a method for implementing this self-stripping method, in the case of fixing a color image, there is widely adopted a method normally in which there is used a fixing roll roller having an elastic layer made of silicone rubber having higher mold release characteristics than fluorine resin, formed on the surface of the roll core, and in which a comparatively large quantity (10 mg or more/A4-size sheet) of oil is always supplied to the surface of the elastic layer.

However, a conventional fixing device which achieves self-stripping has the following various problems:

(1) The reliability of the fixing roller may be reduced by various causes such as wearing of an elastic layer made of silicone rubber on the surface of the fixing roller or deterioration of mold release characteristics or an elastic layer deterioration rated by oil permeated into the fixing roller.

(2) It is inferior in maintainability because oil must be periodically replenished, and is not suitable for a small-sized copying machine or a printer.

(3) Oil easily remains on a copy, which easily deteriorates the touch-up ability with a ball-point pen or in ink.

The present invention has been achieved in the light of the above-described state of affairs, and is aimed to provide a fixing device having a peeling sheet, capable of stably peeling without causing any damage to the image, the sheet and the fixing roller.

SUMMARY OF THE INVENTION

[Means for Solving the Problems]

A first fixing device according to the present invention which achieves the above-described objectives is characterized in that the fixing device is comprised of a first rotator having a heat source therein, which rotates in a predetermined direction and a second rotator which rotates in the opposite direction relative to the direction of rotation of the first rotator while being in contact with the first rotator. The first fixing device fixes a non-fixed toner image on a sheet by heating and compressing the sheet carrying the non-fixed toner image on the surface in contact with the first rotator, which has been conveyed through a nip portion comprising two rotators in contact with each other.

The first rotator is formed with an elastic layer on the surface thereof.

Additionally, there is provided a peeling sheet, whose end edge comes into contact with the surface of the first rotator to peel the sheet once the sheet has passed through the nip portion, away from the surface of the first rotator, downstream of the nip portion of the first rotator in the direction of rotation thereof.

Also, a second fixing device according to the present invention which achieves the above-described objectives is characterized in that the fixing device is comprised of a first rotator having a heat source therein, which rotates in a predetermined direction, and a second rotator which rotates in the opposite direction relative to the direction of rotation of the first rotator while being in contact with the first rotator. The first fixing device fixes a non-fixed toner image on the sheet by heating and compressing the sheet for carrying the non-fixed toner image on the surface in contact with the first rotator, which has been conveyed through a nip portion comprising these two rotators in contact with each other.

Additionally, there is provided a peeling sheet comprising a contact portion of the first rotator for contacting the surface of the first rotator downstream of the nip portion of the first rotator in the direction of rotation thereof and also extending on the upstream side. The peeling sheet further comprises a tip end portion having a shape further extending upstream of the contact portion in the direction of rotation of the first rotator, is spaced apart at a predetermined interval from the surface of the first rotator, and has passed through the nip portion, away from the surface of the first rotator.

BRIEF DESCRIPTION OF THE DRAWINGS

FIG. 12 is a table showing experimental results of the maximum peeling force when a hard roller with flourine resin is used as the fixing roller;

FIG. 13 is a table showing experimental results of the maximum peeling force when color fixing was performed using, as the fixing roller, a soft roller with a coating of silicone rubber of thickness 0.1 mm to 1.0 mm and further coating the silicone rubber with a flourine resin layer;

FIG. 14 is a table showing experimental results of the maximum peeling force when color fixing was performed using, as the fixing roller, a soft roller with a coating of silicone rubber of thickness 0.3 mm;

FIG. 15 is a table showing experimental results of uneven gloss affects relative to the distance between the nip outlet and the peeling point; and FIG. 16 is a table showing experimental results of the occurrence of stains on the peeling film and peeling performance relative to the clearance between the end edge of the peeling sheet and the fixing roller.

DETAILED DESCRIPTION OF PREFERRED EMBODIMENTS

[Embodiments of the Invention]

Hereinafter, embodiments according to the present invention will be described.

Figure 1:
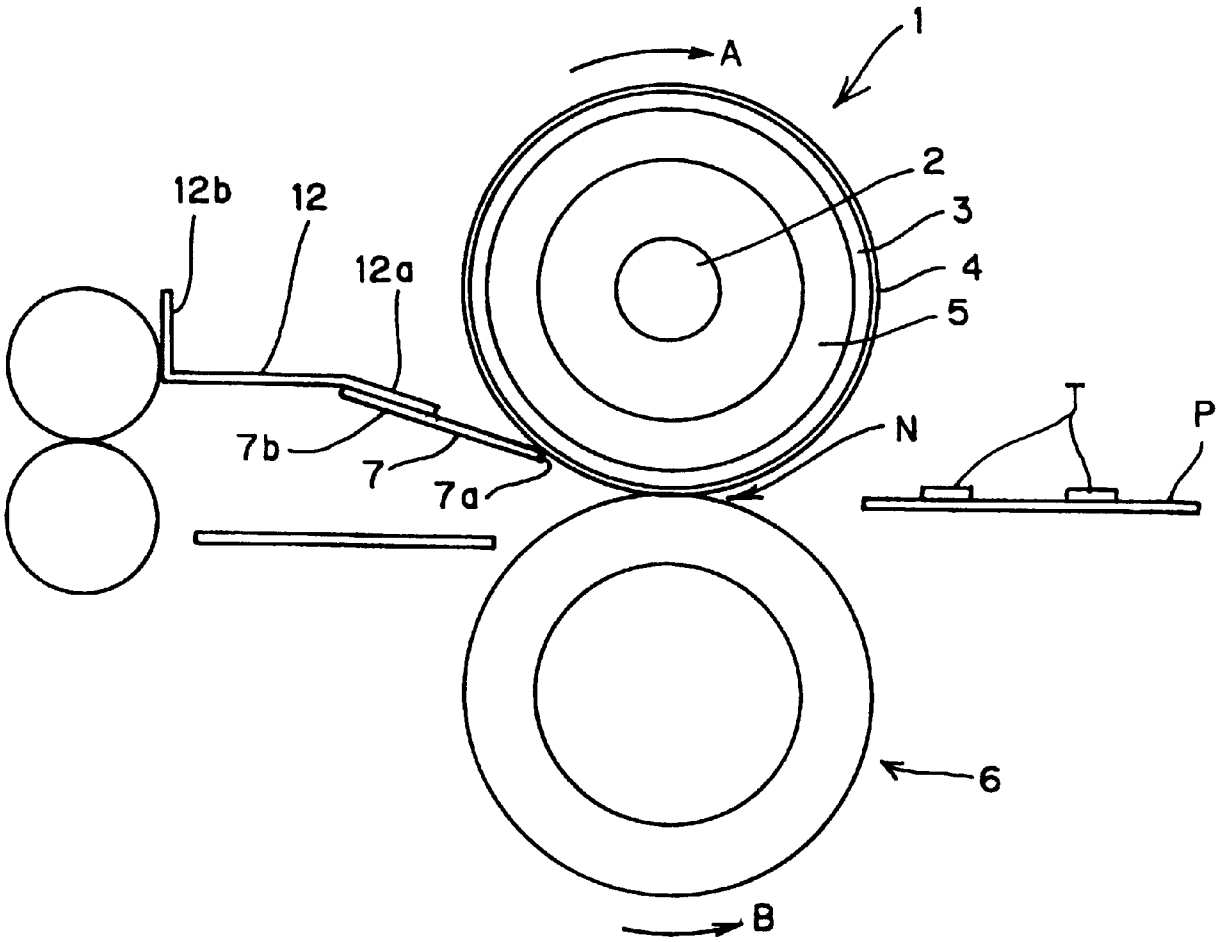
FIG. 1 is a schematic structural view showing a first embodiment of a fixing device according to the present invention.

FIG. 1 is a schematic structural view showing a first embodiment of a fixing device according to the present invention.

A fixing device shown in FIG. 1 corresponds to the first fixing device according to the present invention, and comprises: a fixing roller 1, which rotates in a direction indicated by an arrow A; and a compression roller 6 for rotating in a direction indicated by an arrow B, which is opposite to the direction of rotation A of the fixing roller 1 while being in contact therewith. A sheet P carrying a non-fixed toner image T on the surface thereof , which has been conveyed to a nip portion N between the pair of rollers 1 and 6, is heated and compressed to fix the non-fixed toner image T on the sheet P. On the downstream side of the nip portion N of the fixing roller 1 in the direction of rotation A thereof, there is provided a peeling sheet 7 whose end edge comes into contact with the surface of the fixing roller 1 to peel the sheet P, which has passed through the nip portion N, away from the surface of the fixing roller 1.

Here, the fixing roller 1 according to this embodiment corresponds to the first rotator in the present invention, and the compression roller 6 according to this embodiment corresponds to the second rotator in the present invention.

The fixing roller 1 is formed by coating an aluminum core 5 on the surface with a 0.5 mm thick elastic layer 3, and further on top of it, coating with a 20 μm thick surface layer 4, and has a heater 2 therein as a heat source. In this embodiment, as the elastic layer 3, there is used silicone LSR rubber (Liquid Silicone Rubber) having hardness of rubber of 25°. Also, as the surface layer 4, a PFA (perfluoroalkoxyfluoro plastics) tube is used.

In this respect, as the material for the elastic layer 3, rubber containing fluorine can be used in addition to silicone rubber, and an elastic layer having a plurality of layers consisting of silicone rubber and rubber containing fluorine may be used.

Figure 2:
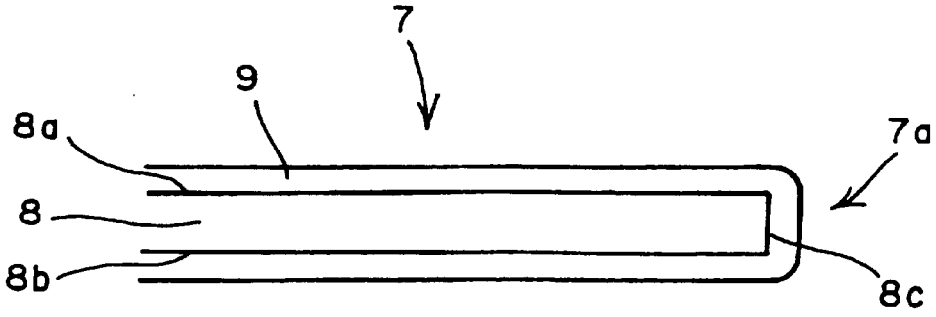
FIG. 2 is a cross-sectional view showing a peeling sheet provided for a fixing device according to the first embodiment.

FIG. 2 is a cross-sectional view showing a peeling sheet provided for or a fixing device according to the first embodiment.

As shown in FIGS. 1 and 2, the peeling sheet 7 comprises: a 75 μm-thick base member 8 made of polyimide, and a surface 8*a* of the base member 8, a back surface 8*b* thereof, and an end edge 8*c* in contact with the fixing roller 1 which are coated with a 10 μm-thick fluorine resin layer 9. In order to form the fluorine resin layer 9, for example, PFA film can be used.

In this respect, in this embodiment, as the base member 8 for the peeling sheet 7, polyimide is used, but the base member 8 for the peeling sheet 7 is not limited to polyimide, but a heat-resistant plastic sheet or a metallic sheet may be used.

The peeling sheet 7 is arranged along the direction of a tangent line drawn, when the end edge 7*a* at the tip end portion of the peeling sheet 7 comes into contact with the fixing roller 1, from its contact toward the direction of rotation A of the fixing roller 1. The end edge 7*a* of the peeling sheet 7 is wide enough to contact the entire width of the fixing roller 1 in the axial direction, and the peeling sheet 7 at its rear end portion 7*b* is fixed to the tip end portion 12*a* of a metal supporting plate 12 so that the end edge 7*a* is pressed against the surface of the fixing roller 1 at contact pressure of 300 g. The supporting plate 12 at its rear end portion 12*hb* is fixed to the frame (not shown) of this fixing device by screws. The peeling sheet 7 is formed to be comparatively short so that the length between the end edge 7*a* of the tip end portion and the rear end portion 7*b* is approximately 2 mm to 7 mm, and therefore, provides sufficient rigidity in spite of the thin sheet.

The contact pressure between the end edge 7*a* of the peeling sheet 7 and the fixing roller 1 is equivalent to a peeling force. Specifically, when a toner image T on the sheet P is heated and compressed in the nip portion N to fuse the toner image, and is going to adhere to the fixing roller 1, it is necessary that the peeling sheet 7 be pressed against the fixing roller 1 with a contact pressure equivalent to a peeling force. The peeling force is determined by the properties of the toner image to be fixed and the sheet. In this respect, a measuring method for the peeling force will described later.

Also, the contact pressure between the peeling sheet 7 and the fixing roller 1 is determined in consideration of links with the following various elements in addition to the link with the peeling force.

First, the minimum value for the contact pressure must be a sufficient value to cause waviness to occur at the end edge 7*a* of the peeling sheet 7, and the maximum value for the contact pressure must be a value equal to or less than a critical amount of deflection or a plastic deformation starting load of the peeling sheet or the limitation at which the fixing roller 1 is scratched. From these constraints, the optimum value for the contact pressure in practical use is within a range of 100 g to 500 g at the width of an A4-size sheet in horizontal orientation of 297 mm.

In the case where a heat-resistant plastic sheet is used as a base member for the peeling sheet 7, the thickness of the peeling sheet 7 for obtaining this contact pressure must be 50 μm or more. When, however, the thickness of the peeling sheet 7 exceeds 150 μm, the sheet P strikes the end edge 7*a* of the peeling sheet 7 so that the sheet P cannot be smoothly peeled off, and therefore, the optimum sheet thickness in practical use is preferably 50 μm to 150 μm.

In this embodiment, the end edge 7*a* of the peeling sheet 7 is coated with a 10 μm-thick PFA film, and therefore, the peeling sheet 7 will not be scratched even if the toner image in a fused state immediately after fixing rubs the surface of the peeling sheet 7. This is because the contact pressure per unit area of the peeling sheet 7 becomes lower since the toner image is supported by the end edge 7*a* of the peeling sheet 7 over the entire surface. If, however, the width of the peeling sheet 7 is narrower than that of the sheet P, the toner image will be rubbed against the end edge 7*a* of the peeling sheet 7 at both ends to cause streaks on the toner image, thus resulting in image quality defects. Therefore, the width of the peeling sheet 7 in the axial direction of the fixing roller must cover the entire width of the sheet.

In a fixing device according to this embodiment, the toner or paper powder offset on the fixing roller 1 may be scraped off by the end edge 7*a* of the peeling sheet 7 to accumulate on the upper surface of the peeling sheet 7 close to the end edge 7*a*. Since, however, the end edge 7*a* is coated with fluorine resin, the adherence of the toner or paper powder on the peeling sheet 7 is low, and the toner or paper powder, even if accumulated more or less, is removed when the tip end of the next sheet P which has be been supplied to the nip portion N comes into contact with the toner or paper powder accumulated, and few stains occur.

In this respect, the peeling sheet 7 is preferably arranged obliquely so that the end edge 7*a* of the peeling sheet 7 is inclined in the axial direction of the fixing roller 1 to contact the surface thereof. More specifically, the peeling sheet 7 is obliquely arranged to the axis of the fixing roller 1 in such a manner that distances between both side ends of the end edge 7*a* in the width direction and the nip portion N are caused to have a difference of approximately 0.5 mm to 2 mm at both side ends, whereby it becomes possible to start peeling of the sheet P gradually at one side end in the width direction. In a case where there is a solid black image in the vicinity of the tip end of the sheet P, the impactive force, which occurs at the commencement of peeling, can be reduced.

As described above, the first fixing device according to the present invention is a combination of the advantage of the forced peeling method using a peeling sheet which could not be used for color fixing conventionally although it has been used for monochrome fixing and the advantage of the self-stripping method. This implements a fixing device capable of reducing the peeling force of a sheet in color fixing to the same level as the peeling force in monochrome fixing by using an elastic layer as the surface of the fixing roller to thereby cause the sheet to have a self-stripping force, and of performing stable peeling without causing any damage to the image, the sheet, and the fixing roller even in the case of color fixing, fixing, by pressing the peeling sheet against the fixing roller at low contact pressure.

The above-described peeling force is measured by the following measuring apparatus.

Figure 3:
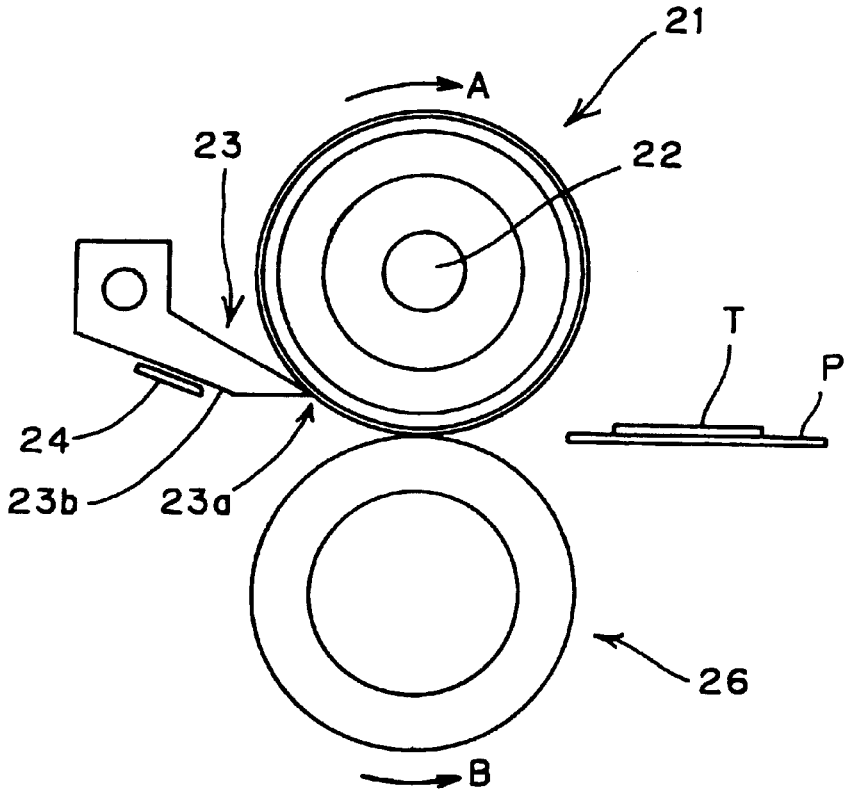
FIG. 3 is a schematic structural view showing a peeling force measuring apparatus.

FIG. 3 is a schematic structural view showing a peeling force measuring apparatus.

As shown in FIG. 3, this peeling force measuring apparatus comprises: as in the case of an actual peeling device, a fixing roller 21, which rotates in a direction indicated by an arrow A; and a compression roller 26 for rotating in a direction B, which is opposite to the direction of rotation A of the fixing roller 21 while being in contact therewith. A heater 22 is provided inside the fixing roller 21 as a heat source. A sheet P carrying a non-fixed toner image T on the surface thereof, which has been conveyed to a nip portion N between the pair of rollers 21 and 26, is heated and compressed to fix the non-fixed toner image T on the sheet P.

On the downstream side of the nip portion N of the fixing roller 21 with respect to the direction of rotation A thereof, there is provided a peeling claw 23 to peel the sheet P, which has passed through the nip portion N, away from the surface of the fixing roller 21. The end edge 23*a* of the peeling claw 23 is pressed against the surface of the fixing roller 21 at predetermined contact pressure. On the back surface 23*b* of the peeling claw 23, a strain gauge 24 is stuck, and measures the contact pressure, i.e., peeling force which acts on the peeling claw 23 on forcibly peeling the fixed toner image by the peeling claw 23 after the sheet P carrying the non-fixed non-fixed toner image T thereon passes through the nip portion N.

As concrete measurement conditions, a solid non-fixed test image is formed in an image size of 100 mm wide×80 mm long on an A4-size sheet S produced by Fuji Xerox Co., Ltd., and this solid non-fixed test image is fixed at a sheet conveying speed of 100 mm/sec by a fixing roller 21 set to heating temperatures in 10° C. increments to detect the peeling force at the time with the strain gauge 24. The fixing conditions at the time are as follows:

Fixing roller: Fluorine resin coated hard roller comprising a 20 $\mu$m thick PFA tube coated on a 40-mm-dia aluminum core.

Compression roller: Elastic roller comprising a 3 mm thick silicone rubber having rubber hardness of 60° coated on a 34-mm-dia aluminum core.

Nip width: 6 mm.

Toner: For monochrome toner, toner for Vivace 550 produced by F Co. is used. Toner weight per unit area is 0.65 mg/cm$^2$. For color toner, toner for A Color-620 produced by F Co. containing 4 wt % of polyester wax and 1 wt % of polypropylene wax is used, toner weight per unit area being 2.0 mg/cm$^2$.

The result obtained by measuring using this measuring apparatus is shown in FIG. 12, FIG. 13 and FIG. 14.

[FIG. 12]

As shown in FIG. 12, in the case where a so-called hard roller coated with fluorine resin is used as the fixing roller, the maximum peeling force is 10 g within an allowable temperature range for fixing in monochrome fixing, while in color fixing, the maximum peeling force is increased to 130 g, 13 times that in the monochrome fixing, for a 100 mm-wide test image. Therefore, an impactive active force of about 400 g is needed to act on the peeling sheet at the instant of peeling in order to fix a color image having a width of 297 mm, which is the width of an A4-size sheet in horizontal orientation. For this reason, a 75 $\mu$m-thick peeling sheet made of polyimide is likely to be plastically deformed, and the tip end of the sheet may also be seriously damaged to cause waviness or paper jamming.

According to the experiments of the present inventors et al, it is confirmed that a critical load at which stable peeling can be performed without causing any damage to the tip end of the sheet, and without causing the peeling sheet to be plastically deformed or to curl up is 70 g for a 100 mm-wide test image, or about 200 g when converted to 297 mm, which is the width of an A4-size sheet in horizontal orientation.

Also, from a series of experimental results shown in FIG. 12, it can be seen that the toner weight per unit area is substantially in proportion to the maximum peeling force. Also, it has been confirmed that in order to cause color toner to sufficiently develop colors, the toner is sufficiently heated to lower the toner viscosity, and as the toner is brought close to a melted and fluid state, the maximum peeling force becomes greater, namely, when the image glossiness is enhanced, a great peeling force is required.

From the foregoing, it can be seen that in the case of color fixing, a peeling force being required greater than monochrome fixing results from two factors: (1) greater toner weight and 12) enhanced image glossiness.

As shown in FIG. 12, the toner weight in the case of color fixing is decreased from 2.0 mg/cm$^2$ to 0.65 mg/cm$^2$, which is nearly the same as that in the case of monochrome fixing, whereby the peeling force can be lowered to 10 to 20 g, which is nearly the same as in the case of monochrome fixing.

As a result, however, the image glossiness is decreased from 80 gloss (75°–75° measurement)to 15 gloss (75°–75° measurement), which is nearly the same as in the case of monochrome fixing, and the quality of the color image is significant significantly deteriorated, and therefore, such a method cannot be adopted.

Thus, the present inventors et al studied the fixing roller in order to cause the peeling sheet to become applicable to color fixing. First, focusing attention on the surface structure of the fixing roller, a so-called hard roller having a fluorine resin layer formed on the surface thereof was compared with a so-called soft roller having an elastic layer formed on the surface thereof in peeling force. For the measuring apparatus, a peeling force measuring apparatus shown in FIG. 3 was used.

FIG. 13 shows the measurement result obtained when color fixing was performed using, as the fixing roller, a so-called soft roller prepared by coating a 40-mm-dia core made of aluminum with silicone LSR rubber having a thickness of 0.1 mm to 1.0 mm and hardness of rubber of 25° as an elastic layer, and further coating the elastic layer on the surface with a fluorine resin layer. As the fluorine resin layer, a 20 μm-thick PFA tube is used.

[FIG. 13]

As shown in FIG. 13, if the thickness of the elastic layer (silicone rubber) of the fixing roller is under 0.3 mm, the maximum peeling force exceeds the above-described critical load: 70 g, but if the thickness of the elastic layer exceeds 0.3 mm, the maximum peeling force can be decreased to a level equal to or less than critical load: 70 g at which stable peeling can be performed.

Therefore, whereas in a conventional soft roller, peeling using self-stripping has been performed by increasing the thickness of the elastic layer up to 2 mm to about 3 mm to thereby decrease the peeling force to about 10 g or less, it can be made into a soft roller having as thin an elastic layer as a little over 0.3 mm according to the present invention. Since the elastic layer has a low coefficient of thermal conductivity, the thickness of the elastic layer of the soft roller can usually be made thinner, whereby the heat source provided within the fixing roller can be made smaller, and the diameter of the fixing roller also becomes smaller. Therefore, it becomes possible to miniaturize the fixing device.

As described above, it can be seen that the peeling force can be greatly decreased by the use of a fixing roller having an elastic layer formed on the surface thereof. Also, it is possible to decrease the peeling force to a value equal to or less than 70 g, which is a critical load which does not damage the sheet or the peeling sheet, and the peeling sheet is applicable to the fixing device in a color image recording apparatus.

As regards a mechanism in which the peeling force is decreased by coating a fixing roller on the surface with an elastic layer, it is considered that the elastic layer is deformed within the nip so as to wrap the toner image in, and a micro-slip occurs on an interface between the toner image and the elastic member when the deformed elastic member is going to return to the original state at the time of release of the pressure at the nip outlet, and this micro-slip decreases the peeling force. Accordingly, the thickness of the elastic layer required to decrease the peeling force is a thickness at which the elastic layer can be deformed so as to wrap the toner in by absorbing a height of the toner layer on the sheet by the elastic layer. If the height of the toner layer is within 10% of the thickness of the elastic member layer when the elastic layer is compressed within the nip, the height of the toner layer can be absorbed. Taking into consideration that the maximum height of the toner layer is about 30 μm in the case of forming a color image, the thickness of the elastic layer required is to become 0.3 mm or more.

If a fluorine resin layer is formed on the surface of the elastic layer, the fluorine resin layer will act so as to prevent the elastic deformation, but if the thickness of the fluorine resin layer is equal to or less than the height of the toner layer, namely about 30 μm or less, the toner layer height absorbing ability of the elastic member will be hardly decreased.

From the foregoing, the thickness of the elastic layer preferably exceeds 0.3 mm, and in the case where the elastic layer is coated with fluorine resin on the surface, if the thickness is 0.03 mm or less, the peeling force can be decreased to a value or less at which the peeling sheet is applicable, even in the case of color fixing, and it is possible to materialize a fixing device capable of stable peeling without causing any damage to the image, the sheet, and the fixing roller.

FIG. 14 shows the measurement result for the peeling force obtained when color fixing was performed using, as the fixing roller, a soft roller having a 40-mm-dia core made of aluminum coated only with 0.3-mm-thick silicone rubber as an elastic layer. For the measuring apparatus, a peeling force measuring apparatus shown in FIG. 3 was used.

In this case, since the fixing roller has no surface layer made of fluorine resin unlike the fixing roller of FIG. 13, the surface of silicon silicone rubber will be worn in a short time and not be able to be put to practical use if no oil is supplied to the surface of the fixing roller. Thus, fixing was performed while oil of 1 mg/A4-size sheet to 10 mg/A4-size sheet is being supplied to the surface of the fixing roller to measure the peeling force.

[FIG. 14]

In the case where the amount of oil supplied is 0 as shown in FIG. 14, a measurement value for the peeling force of 65 g is obtained, but if fixing is continued while no oil is being supplied, degradation in image will be caused because of wear in the silicone rubber, and therefore, fixing cannot be performed under this condition. However, by supplying as slight oil as about 1 mg/A4-size sheet to the surface of the fixing roller, it is possible to prevent the silicone rubber from being worn, and also to substantially decrease the peeling force. If the amount of oil supplied is further increased to an amount of oil supplied of 10 mg/A4-size sheet, which is nearly the same as in the conventional color fixing, the peeling force will be able to be decreased to an area close to self-stripping. If, however, the amount of oil supplied is great, the peeling sheet will scrape the oil off to cause the tip end of the peeling sheet to become wet with the oil, and it is transferred to the tip end of the sheet, thus possibly causing oil stains. For this reason, in the case of a fixing device having a peeling sheet, it is necessary to set the amount of oil supplied to 1 mg/A4-size sheet or less in practical use. As shown in FIG. 14, the peeling force is 20 g even in the case of the amount of oil supplied of 1 mg/A4-size sheet, and the peeling sheet is applicable.

Even in a fixing roller in which no fluorine resin layer is formed on the surface of the elastic layer, but only an elastic layer is formed in this way, it is possible to decrease the peeling force by supplying a small amount of oil to the surface of the fixing roller. When, however, oil is used as described above, the oil is prone to cause the following various problems: it is permeated into the fixing roller to deteriorate the reliability; an oil replenishing equipment is required; or the oil remains on a copy to deteriorate the touch-up ability using a ball-point pen or in ink, among others. Therefore, there is preferably used a fixing roller having a fluorine resin layer formed on the surface of the elastic layer of the fixing roller as shown in FIG. 13.

In this respect, even in the case of a fixing roller having a fluorine resin layer on the surface of the elastic layer, it is possible to decrease the peeling force by about half by supplying an amount of oil of 1 mg/A4-size sheet. In this case, the amount of oil supplied is also preferably set to 1 mg/A4-size sheet or less in order to avoid oil stains.

Next, an embodiment of a second fixing device according to the present invention will be described.

Figure 4:
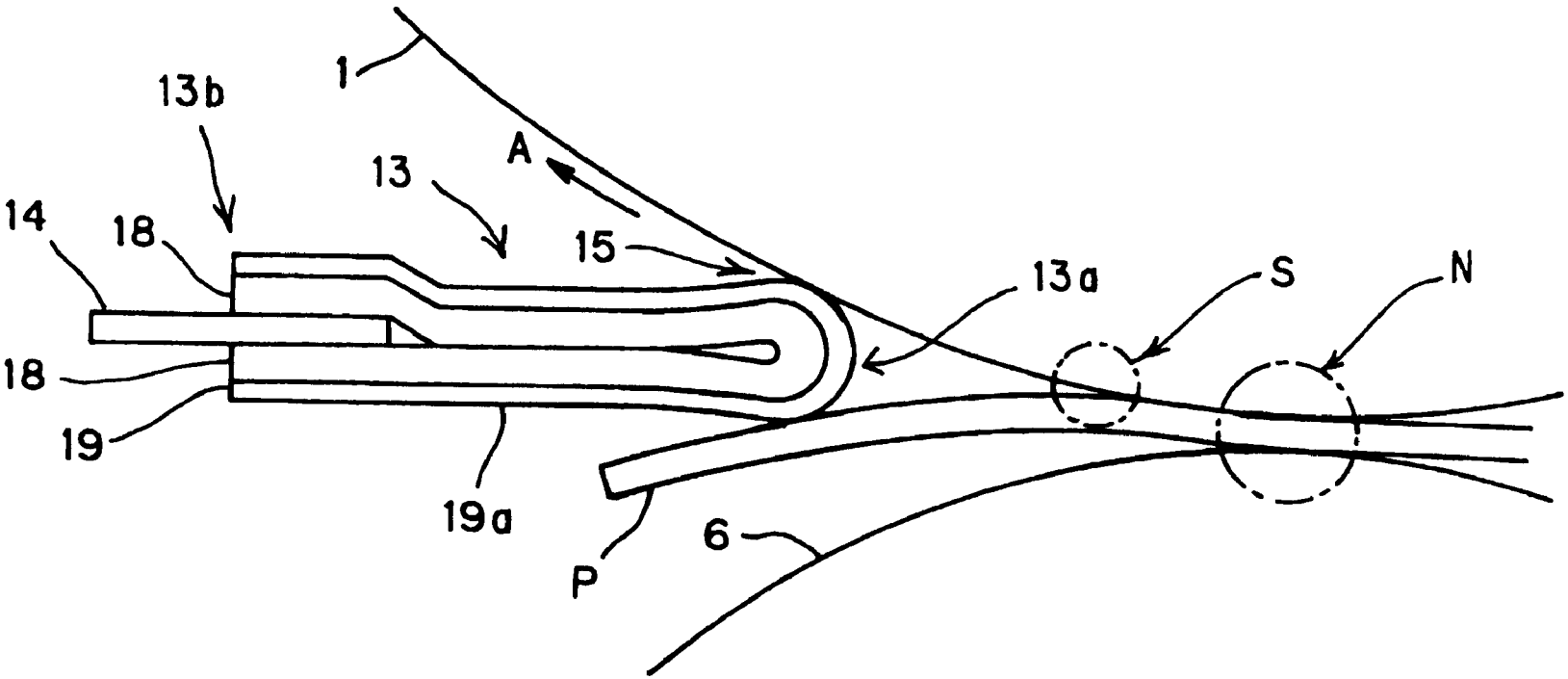
FIG. 4 is a cross-sectional view showing a peeling sheet used for a second fixing device according to the present invention.

FIG. 4, is a cross-sectional view showing a peeling sheet for use in the second fixing device according to the present invention.

FIG. 4 shows a peeling sheet 13 for use in the second fixing device according to the present invention. The second fixing device according to the present invention comprises: as in the case of the first fixing device according to the present invention, a first rotator, which has a heat source therein, and rotates in a predetermined direction; and a second rotator for rotating in the opposite direction with respect to the direction of rotation of the first rotator while being in contact therewith. Additionally, to fix the non-fixed toner image on the sheet, the device heats and compresses a sheet and carries a non-fixed toner image on the surface thereof in contact with the first rotator, which has been conveyed through a nip portion comprising two rotators in contact with each other. The second fixing device according to the present invention is different from the first fixing device according to the present invention in the following two points.

The first point of difference is that a peeling sheet 13 provided for the second fixing device according to the present invention is different in structure and operation from the peeling sheet 7 (see FIG. 1) provided for the first fixing device according to the present invention. More specifically, the peeling sheet 13 provided for the second fixing device according to the present invention comprises: a contact portion 15, of the fixing roller 1 (first rotator), for contacting the surface of the fixing roller 1, downstream of the nip portion N of the fixing roller 1 with respect to the direction of rotation A thereof and also extending on the upstream side. The peeling sheet further comprises tip end comprises portion 13*a* having a shape further extending upstream of the contact portion 15 with respect to the direction of rotation A of the fixing roller 1, and is arranged spaced apart a predetermined interval from the surface of the fixing roller 1.

The second point of difference is that whereas in the first fixing device according to the present invention, it is an essential condition to have the elastic layer 3 (see FIG. 1) formed on the surface of the fixing roller, in the second fixing device according to the present invention, it is not an essential condition to have the elastic layer 3 on the surface of the fixing roller.

As shown in FIG. 4, a peeling sheet 13 according to this embodiment is such that a 40 μm-thick polyimide film, on one side of which a 10 μm-thick fluorine resin layer 19 is formed, is used as a base member 18, and a laminated member formed by folding the base member 18 into two leaves with a surface 19*a*, on which the fluorine resin layer 19 is formed, placed on the outside, is arranged so that a tip end portion 13*a* of the laminated member, on the side on which the fold has been formed, faces the nip portion N. In this respect, the base member 18 is not limited to the polyimide film, but a heat-resistant plastic sheet or a metallic sheet can be used.

The layer thickness of the peeling sheet 13, which has become the laminated member, is about 100 μm. At the end edge 13*a* on the side of the nip portion N, there exists a bulge formed when the peeling sheet 13 has been folded into two leaves, and this bulge portion constitutes a contact portion 15 which comes into contact with the fixing roller 1. The thickness of the peeling sheet 13 in the vicinity of the contact portion 15 is about 110 μm.

The other end edge 13*b* of the peeling sheet 13 is adhered in such a manner that both ends of the base member 18 folded into two leaves sandwich a supporting plate 14 therebetween. The length between the end edge 13*a* of the peeling sheet 13 on the side of the nip portion N and the end edge 13*b* on the side on which the base member is supported by the supporting plate 14 is 5 mm. The width of the peeling sheet 13 in the axial direction of the fixing roller 1 is set to a width to cover the entire width of a sheet passing through. The peeling sheet 13 is arranged so that the contact portion 15 formed in the vicinity of the end edge 13*a* is urged against the fixing roller 1 in a state in which it is supported by the supporting plate 14.

The peeling performance of the peeling sheet 13 according to this embodiment is substantially the same as that of the peeling sheet 7 (see FIG. 1) in the first embodiment.

In a fixing device according to this embodiment, the contact portion 15 of the peeling sheet 13 is in contact with the fixing roller 1, and offset toner on the fixing roller 1 is likely to adhere to the peeling sheet 13. In order to make it difficult for the offset toner to adhere to the peeling sheet 13, the peeling sheet 13 is coated on the surface with the fluorine resin layer 19 having high mold release characteristics.

Here, how to produce the peeling sheet having the surface of its tip end portion coated with a fluorine resin layer, poses a problem. As the simplest producing method, there is considered a method of cutting a sheet-shaped polyimide base member coated with fluorine resin to make into a peeling sheet having a predetermined size, but this method is undesirable because fluorine resin is not present in the section of the base member and toner easily adheres to that portion. There is also considered a method of cutting the base member to a predetermined size and thereafter, coating the individual base members with fluorine resin, but according to this method, it is difficult to coat the section, particularly the edge portion with fluorine resin, possibly resulting in portions which are not coated with fluorine resin locally.

In contrast, in a peeling sheet 13 produced in accordance with the two-sheet folding method according to this embodiment shown in FIG. 4, the end edge 13*a* of the peeling sheet 13 on the side of the nip portion N is also formed with a fluorine resin layer 19 having a predetermined thickness to prevent toner from adhering. Also, since it is produced in accordance with the two-leaf folding method, no sharp edge is formed at the end edge 13*a*, but the end edge has a shape to make it difficult to scrape offset toner. Therefore, even in a case where a toner image on the sheet P (see FIG. 1) offsets on the fixing roller 1 in a large quantity, the fixing roller 1 makes one revolution while almost all offset toner and paper powder adhere to it, and thereafter, they are carried away by the paper P to prevent the peeling sheet 13 from being contaminated. Even if a part of offset to toner and paper powder is temporarily accumulated on the end edge 13*a* of the peeling sheet 13, the tip end of the next sheet P supplied to the nip portion N comes into contact with the toner and paper powder accumulated on the end edge 13*a* to carry them away outside of the device, and therefore, the peeling sheet 13 is prevented from being contaminated.

The peeling sheet 13 according to this embodiment has an advantage that it is difficult to scratch the toner image surface even if the tip end of the peeling sheet 13 rubs on peeling the toner image T on the sheet P because the tip end portion 13*a* has a smooth and large curvature. Also, by the same token, the peeling sheet 13 according to this embodiment is of such structure that it is difficult to scratch the fixing roller 1. Furthermore, the large curvature at the tip end of the peeling sheet 13 decreases the probability that the tip end of the sheet P collides head-on against the tip end of the peeling sheet 13, thus allowing the sheet P to be peeled more stably.

For the above-described reasons, the maximum peeling force, described with reference to FIG. 13, i.e., the critical load, at which stable peeling can be performed, can be enhanced to 150 g in this embodiment from 70 g in the first fixing device. Therefore, in this embodiment, it is not always necessary to form an elastic layer on the surface of the fixing roller 1.

In addition, the peeling sheet of this two-leaf folding method also has an advantage by substantially reducing the occurrence of a waviness phenomenon, which is prone to occur at the end edge of the peeling sheet, caused by heating by a heater incorporated within the fixing roller 1. It has been actually confirmed that no waviness phenomenon occurs even if the contact pressure of the peeling sheet 13 against the fixing roller 1 is decreased to about half that in the case of the single-layer peeling sheet 7 (see FIG. 2), and it is possible to decrease the contact pressure in the case of the width of A4-size sheet in horizontal orientation: 297 mm to 30 g.

If a peeling point S, at which the peeling sheet 13 peels from the fixing roller 1, that is, a point S, at which the sheet P which has passed through the nip portion N peels from the fixing roller 1, is excessively far away from the outlet of the nip portion N, the period of time during which the sheet P is carried while it is winding round the fixing roller 1 becomes long, and therefore, the tip end portion of the toner image on the sheet P is excessively heated to give a high gloss to it, thus possibly causing uneven gloss at the tip end portion of the toner image.

At the tip end of a sheet carrying a toner image, there is a non-image formation area in which no image is formed at the formation of an ordinary image. A length between the non-image formation area and the tip end of the sheet is about 5 mm although it varies more or less depending on the image forming apparatus. In a process in which the sheet comes out from the nip portion, the above-described uneven gloss will not occur if the tip end of the sheet starts being peeled by the peeling sheet 13 before the tip end of the toner image goes out of the nip portion.

Thus, we investigated uneven gloss which occurred at the tip end of the toner image by varying the position of the peeling point S in various ways. The result is shown in FIG. 15. The nip width between the fixing roller 1 and the compression roller 6 is 6 mm.

[FIG. 15]

As can be seen from FIG. 15, when a distance between the outlet of the nip portion N and the peeling point S exceeds the length of the non-image formation area of the sheet, namely 5 mm, uneven gloss begins to occur at the tip end portion of the toner image. If the distance between the outlet of the nip portion N and the peeling point S is 6 mm or less, no uneven gloss occurs.

More specifically, in order to prevent uneven gloss from occurring, it is preferable to arrange so that the sheet is peeled from the first rotator (fixing roller) at a position where the distance from the outlet of the nip portion is shorter than the length of the non-image formation area at the tip end of the sheet.

In this respect, the following peeling sheet may be used as a variation of the second embodiment.

Figure 5:
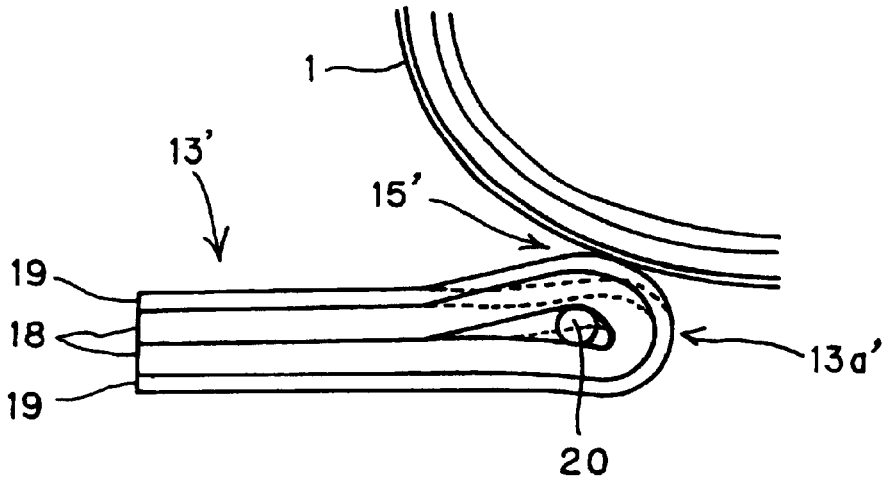
FIG. 5 is a view showing a variation of the peeling sheet shown in FIG. 4.

FIG. 5 is a view showing a variation of the peeling sheet shown in FIG. 4.

As shown in FIG. 5, this peeling sheet 13' uses, as in the case of the peeling sheet 13 shown in FIG. 4, a heat-resistant plastic sheet or a metallic sheet, on one side of which a fluorine resin layer 19 is formed, as a base member 18, and is formed as a laminated member obtained by folding the base member 18 into two leaves with the surface having the fluorine resin layer 19 formed thereon, placed on the outside. Spherical or cylindrical particles 20 having a diameter of 5 to 100 $\mu$m are caused to be interposed between two portions obtained by thus folding the base member 18 into two leaves, whereby a bulge is produced along an end edge 13*a*' of the peeling sheet 13' on the side on which the fold has been formed to form a contact portion 15' slightly larger than the contact portion 15 in the peeling sheet 13 shown in FIG. 4. The particles 20 are interposed between those two portions obtained by folding the base member 18 into two leaves, along the end edge 13*a*' of the peeling sheet 13' at intervals of 10 mm. In this respect, it is possible to bond together those two portions with adhesive. The peeling sheet 13' structured in this way has the same peeling performance as the peeling sheet 13 shown in FIG. 4.

Next, a third embodiment of a fixing device according to the present invention will be described.

When continuous fixing operations for several hundred sheets are performed using a fixing device according to the first or second embodiment, a phenomenon may be seen in which some offset toner and paper powder are temporarily accumulated on the end edge of the peeling sheet, and they are removed by the tip end portion of the next sheet which has been conveyed. As a result, the tip end of the sheet is more or less contaminated, which is not desirable for the image quality. In such cases, it is desirable to use a peeling sheet according to the third embodiment to be described below.

Figure 6:
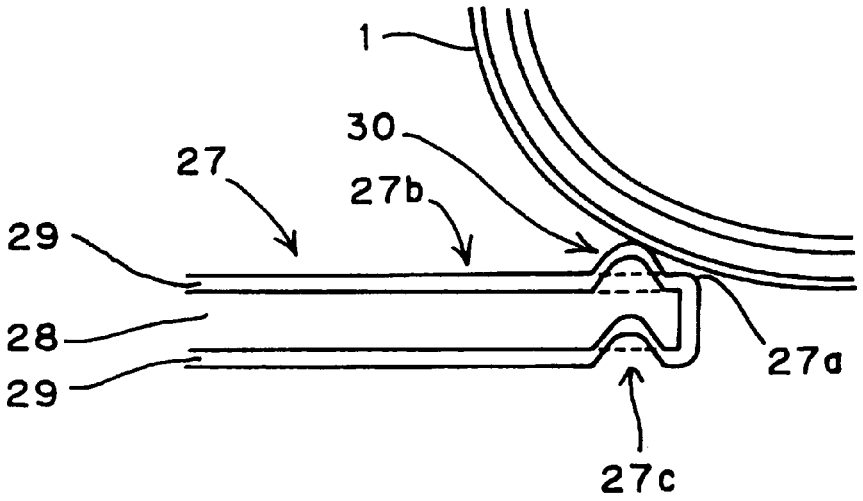
FIG. 6 is a cross-sectional view showing a peeling sheet used for a third embodiment according to the present invention.

FIG. 6 is a cross-sectional view showing a peeling sheet used for a third embodiment according to the present invention.

As shown in FIG. 6, this peeling sheet 27 is formed by coating a base member 28 made of a 75 $\mu$m-thick polyimide film with a 10 $\mu$m-thick fluorine resin layer 29, and a plurality of 20 $\mu$m-high conical protrusions 30 are formed on a surface 27*b*, of the peeling sheet 27, on the side of facing the fixing roller 1 so that they are in contact with the fixing roller 1. The protrusions 30 are about 20 $\mu$m in height, and can be formed by pressing, for plastic deformation, with a die from a surface 27*c* on the side opposite to the surface 27*b*, of the peeling sheet 27, on the side of facing the fixing roller 1. By causing the base member 28 to perform plastic deformation to form the plurality of protrusions in this way, it becomes possible to obtain a peeling sheet having protrusions comparatively easily and at a low price.

Figure 7:
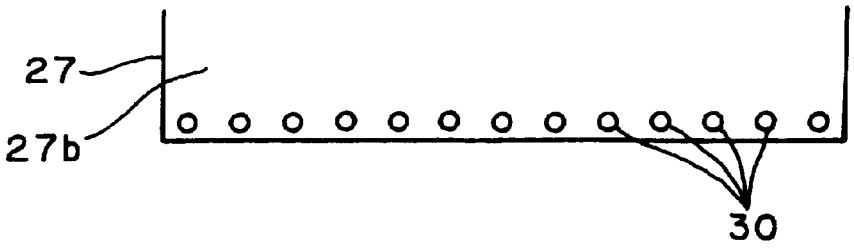
FIG. 7 is a plan view showing the peeling sheet shown in FIG. 6.

FIG. 7 is a plan view for the peeling sheet shown in FIG. 6.

As shown in FIG. 7, the protrusions 30 are formed at intervals of 10 mm in parallel with the axial direction of the fixing roller 1 on a surface 27*b*, on the side of facing the fixing roller 1, of the peeling sheet 27.

Figure 8:
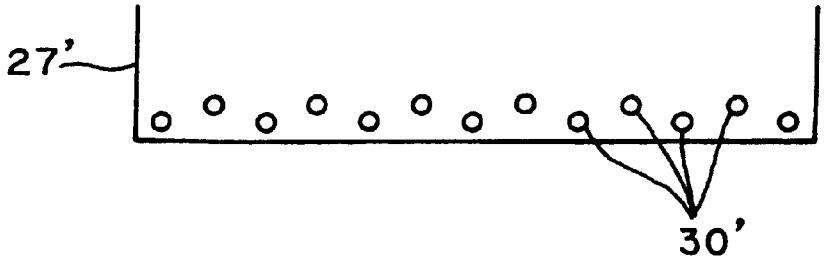
FIG. 8 is a plan view showing a variation of the peeling sheet according to the third embodiment.
Figure 9:
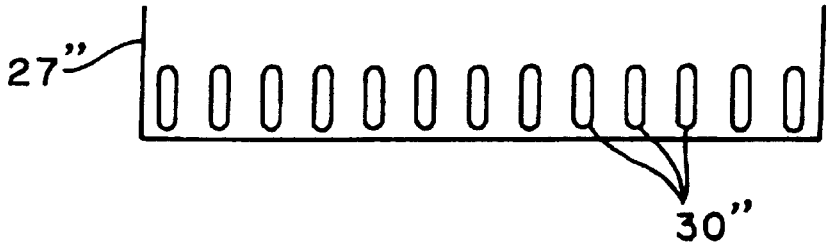
FIG. 9 is a plan view showing another variation of the peeling sheet according to the third embodiment.
Figure 10:
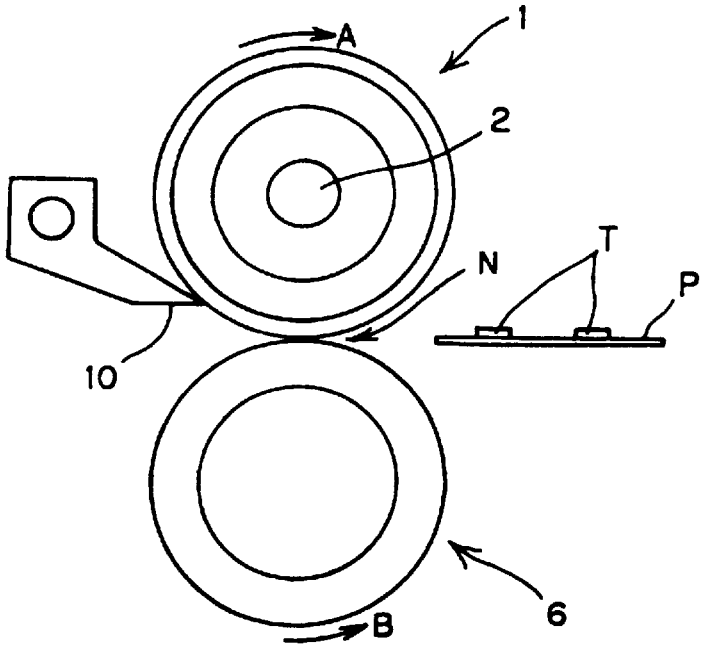
Fig. 10 RELATED ART
FIG. 10 is a schematic structural view showing a conventional fixing device having a forced peeling device using peeling claws.
Figure 11:
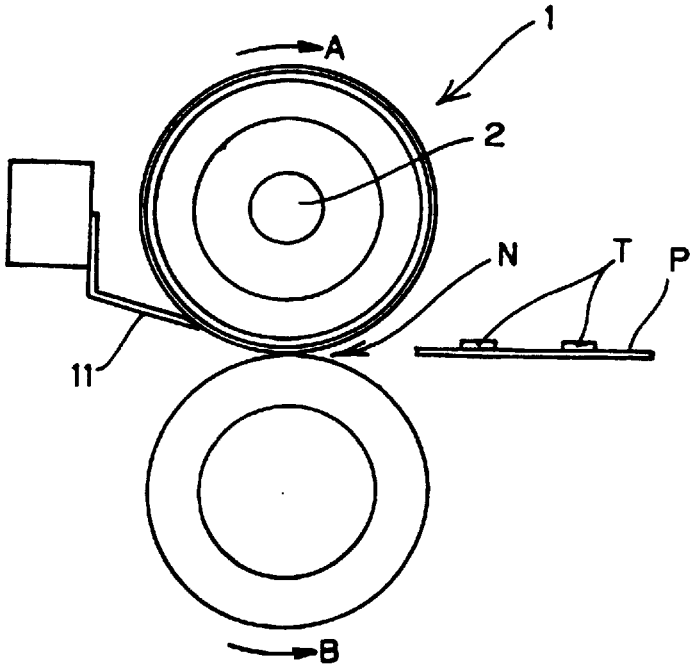
Fig. 11 RELATED ART
FIG. 11 is a schematic structural view showing a conventional fixing device having a forced peeling device using a plastic peeling sheet.

FIG. 8 is a plan view showing a variation of the peeling sheet according to the third embodiment, and FIG. 9 is a plan view showing another variation of the peeling sheet according to the third embodiment.

It is also one of preferred aspects for a fixing device according to the present invention to arrange a plurality of protrusions 30' on the peeling sheet 27' in a zigzag shape as shown in FIG. 8, and it is also a preferred aspect for a fixing device according to the present invention to arrange a plurality of protrusions 30", on a peeling sheet 27" in a semicylindrical shape extending in a direction along the direction of rotation of the fixing roller 1 as shown in FIG. 9.

Next, the description will be made of intervals between any two adjacent ones of the plurality of protrusions in the third embodiment.

As shown in FIG. 6, the peeling sheet 27 in the third embodiment is in contact with the fixing roller 1 through protrusions 30 in the vicinity of the end edge 27*a*, and a clearance of about 20 $\mu$m is kept between the end edge 27*a* of the peeling sheet 27 and the fixing roller 1. Since the peeling sheet 27 uses a thin-film film as the base member 28, the end edge 27*a* of the peeling sheet 27 between any two adjacent ones of the protrusions 30 comes into contact with the fixing roller 1 when the interval between any two adjacent ones of the protrusions 30 is too wide. In order to prevent such a contact, the interval between any two adjacent ones of the protrusions 30 is preferably set to about 3 to 30 mm in consideration of a balance between the interval and the thickness of the peeling sheet 27.

Next, the description will be made of the height of the protrusions from the surface of the peeling sheet in the third embodiment.

FIG. 16 shows the result obtained when the height of the protrusions 30 is varied in various ways using the peeling sheet 27 shown in FIG. 6 to investigate stains by toner and paper powder accumulated on the peeling sheet 27 and the peeling performance. Since the protrusions 30 are formed in the vicinity of the end edge 27*a* of the peeling sheet 27 as shown in FIG. 6, the clearance between the end edge 27*a* of the peeling sheet 27 and the fixing roller 1 is somewhat smaller than the height of the protrusions 30. If this clearance becomes larger, the sheet P which has passed through the nip portion N will enter between the peeling sheet 27 and the fixing roller 1, and will not be able to be peeled from the fixing roller 1.

[FIG. 16]

As shown in FIG. 16, if the clearance between the end edge 27*a* of the peeling sheet 27 and the fixing roller 1 is 100 μm or less, sufficient peeling performance can be exhibited. Also, when the height of the protrusions becomes under 5 μm, offset toner, paper powder and the like begin to adhere to the peeling sheet gradually. Accordingly, the clearance between the end edge 27*a* of the peeling sheet 27 and the fixing roller 1 is preferably set to 5 μm and over to 100 μm incl.

In this respect, in the third embodiment, the protrusions formed on the peeling sheet may be a linear protrusion extending in a direction along the direction of rotation of the fixing roller. By the formation of such a linear protrusion in the vicinity of the tip end portion of the peeling sheet, it is preferably possible to increase the degree of freedom in the design with respect to a delicate displacement in the contact position between the protrusion and the fixing roller.

In each embodiment described above, the description has been made of the examples in which rollers are used as the first and second rotators, but the first and second rotators in a fixing device according to the present invention are not limited only to rollers, but, for example, belt-type rotators may be used.

Also, in each embodiment described above, the description has been made of only the example in which a peeling sheet according to the present invention is applied to peeling of a sheet from the first rotator (fixing roller), but in an image forming apparatus capable of both-side copying, the peeling sheet can be applied to peeling of a sheet from the second rotator (corresponds to the compression roller 6 in each embodiment described above) on making a two-side copy as in the case of each embodiment described above.

[Effect of the Invention]

As described above, according to the first fixing device of the present invention, the first rotator is formed with an elastic layer on the surface, and there is provided a peeling sheet for peeling a sheet from the first rotator by causing its end edge to come into contact with the surface of the first rotator, downstream of the nip portion in the direction of rotation of the first rotator, whereby it is possible to realize a fixing device having a peeling sheet capable of stably peeling a non-fixed toner image formed by transferring a large amount of toner as in the case of color fixing, without causing any damage to the toner image, the sheet, and the first rotator.

Also, according to the second fixing device of the present invention, there is provided a peeling sheet, comprising: a contact portion, of the first rotator, for contacting the surface of the first rotator, downstream of the nip portion of the first rotator in the direction of rotation thereof; and a tip end portion having a shape further extending upstream of the contact portion in the direction of rotation of the first rotator, and extending on the upstream side, arranged spaced apart a predetermined interval from the surface of the first rotator, whereby it is possible to realize a fixing device having a peeling sheet capable of stably peeling a non-fixed toner image on the surface of the first rotator without causing any damage to the toner image, the sheet and the first rotator as in the case of the first fixing device according to the present invention.

What is claimed is:

1. A fixing device, comprising:

a first rotator which rotates in a predetermined direction, said first rotator having a heat source therein and being formed with an elastic layer on the surface thereof;

a second rotator which rotates in an opposite direction relative to the direction of rotation of said first rotator while being in contact with said first rotator, for fixing a non-fixed toner image on a sheet by heating and compressing the sheet carrying the non-fixed toner image on the surface in contact with said first rotator, which has been conveyed to a nip portion where said first and second rotators contact each other; and a peeling sheet, whose end edge is continuously in contact with the surface of said first rotator to peel the sheet, which has passed through said nip portion, away from the surface of said first rotator, downstream of said nip portion in the direction of rotation of said first rotator.

2. The fixing device according to claim 1, wherein said peeling sheet uses a heat-resistant plastic sheet or metallic sheet as a base member, and includes a fluorine resin layer formed on the surface, the back surface and said end edge of said base member.

3. The fixing device according to claim 1, wherein said elastic layer is at least 0.3 mm thick and includes one or more layers made of silicone rubber or fluorine-contained rubber.

4. The fixing device according to claim 3, wherein said first rotator further comprises a fluorine resin layer formed on the surface of said elastic layer, said fluorine resin layer being at most 0.03 mm thick.

5. The fixing device according to claim 1, wherein said peeling sheet is arranged such that a portion of said end edge of said peeling sheet is closer to said nip portion than another portion of said end edge.

6. The fixing device according to claim 5, wherein said portion of said end edge is closer to said nip portion than said another portion of said end edge by approximately 0.5 mm to 2 mm.

7. A fixing device, comprising:

a first rotator which rotates in a predetermined direction, said first rotator having a heat source therein and being formed with an elastic layer on the surface thereof;

a second rotator which rotates in an opposite direction relative to the direction of rotation of said first rotator while being in contact with said first rotator, for fixing a non-fixed toner image on a sheet by heating and compressing the sheet carrying the non-fixed toner image on the surface in contact with said first rotator, which has been conveyed to a nip portion where said first and second rotators contact each other; and a peeling sheet, whose end edge comes into contact with substantially an entire width of a surface of said first rotator to peel the sheet in an axial direction, which has passed through said nip portion, away from the surface of said first rotator, downstream of said nip portion in the direction of rotation of said first rotator.

8. The fixing device according to claim 7, wherein said peeling sheet uses a heat-resistant plastic sheet or metallic sheet as a base member, and includes a fluorine resin layer formed on the surface, the back surface and said end edge of said base member.

9. The fixing device according to claim 7, wherein said elastic layer is at least 0.3 mm thick and includes one or more layers made of silicone rubber or fluorine-contained rubber.

10. The fixing device according to claim 9, wherein said first rotator further comprises a fluorine resin layer formed on the surface of said elastic layer, said fluorine resin layer being at most 0.03 mm thick.

11. The fixing device according to claim 7, wherein said peeling sheet is arranged such that a portion of said end edge of said peeling sheet is closer to said nip portion than another portion of said end edge.

12. The fixing device according to claim 11, wherein said portion of said end edge is closer to said nip portion than said another portion of said end edge by approximately 0.5 mm to 2 mm.

* * * * *